US005542257A

United States Patent [19]

Mattern-Klosson et al.

[11] Patent Number: 5,542,257

[45] Date of Patent: Aug. 6, 1996

[54] CRYOGENIC PUMP WITH AN ESSENTIALLY CUP-SHAPED HOUSING

[75] Inventors: Monika Mattern-Klosson, Roesrath; Hans-Juergen Mundinger, Bruehl; Hans-Ulrich Haefner, Cologne; Uwe Timm, Frankfurt, all of Germany

[73] Assignee: Leybold Aktiengesellschaft, Hanau, Germany

[21] Appl. No.: 256,796

[22] PCT Filed: Apr. 18, 1992

[86] PCT No.: PCT/EP92/00869

§ 371 Date: Jul. 25, 1994

§ 102(e) Date: Jul. 25, 1994

[87] PCT Pub. No.: WO93/15318

PCT Pub. Date: Aug. 5, 1993

[30] Foreign Application Priority Data

Jan. 23, 1992 [DE] Germany ..... 42 01 755.6

[51] Int. Cl.[6] ..... B01D 8/00

[52] U.S. Cl. ..... 62/55.5; 417/901

[58] Field of Search ..... 62/55.5; 417/901

[56] References Cited

U.S. PATENT DOCUMENTS

| | | | |
|---|---|---|---|
| 3,140,820 | 7/1964 | Clausing | 62/55.5 |
| 3,788,096 | 1/1974 | Brilloit | 62/55.5 |
| 4,719,938 | 1/1988 | Pandorf | 62/55.5 |

FOREIGN PATENT DOCUMENTS

| | | |
|---|---|---|
| 2512235 | 9/1976 | Germany . |
| U8804218 | 6/1988 | Germany . |

*Primary Examiner*—Ronald C. Capossela
*Attorney, Agent, or Firm*—Spencer & Frank

[57] ABSTRACT

A cryogenic pump with an essentially cup-shaped housing (2), with a radiation screen (4) disposed in the housing and also essentially cup-shaped, with an inlet opening (6), with a cold head (3) extending into the housing and the radiation screen, with pump surfaces (15) for condensable gases, disposed on the cold head, with a collecting chamber for liquid condensate developing during regeneration of the pump; in order to make possible a regeneration of the pump in various installation positions it is proposed that the condensate collecting chamber is laterally disposed in such a way that the pump (1) can be regenerated even if attached horizontally.

19 Claims, 2 Drawing Sheets

FIG.1
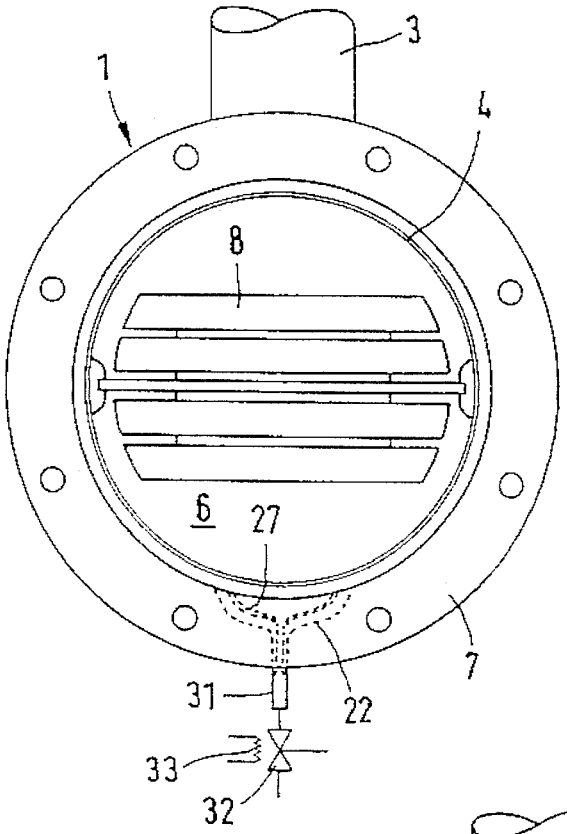
FIG.2
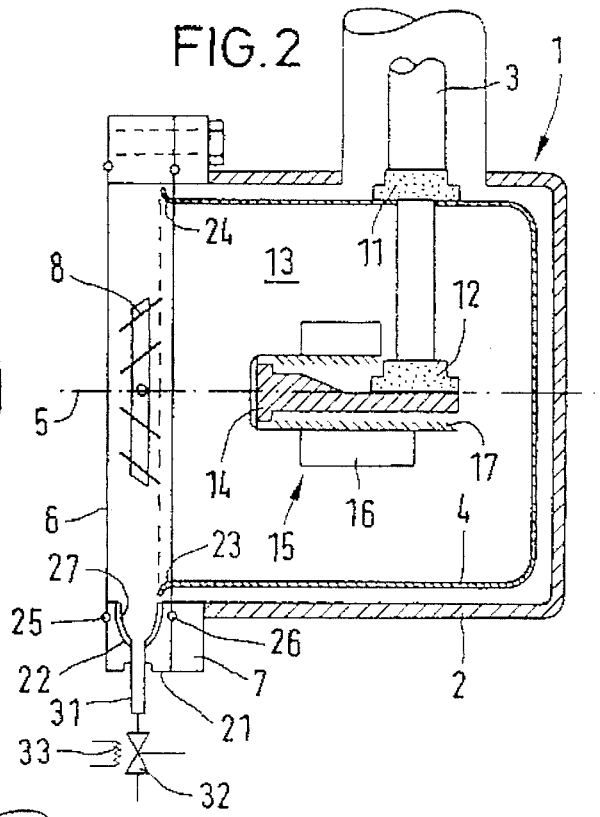
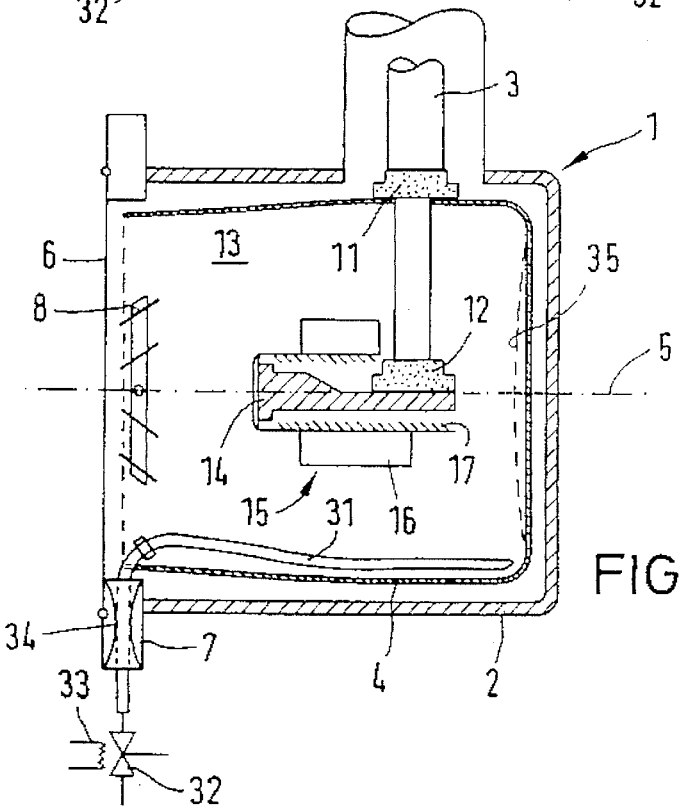
FIG.3

CRYOGENIC PUMP WITH AN ESSENTIALLY CUP-SHAPED HOUSING

BACKGROUND OF THE INVENTION

1. Field of the Invention

The invention relates to a cryogenic pump with an essentially cup-shaped housing, with a radiation screen disposed in the housing and also essentially cup-shaped, with an inlet opening, with a cold head extending into the housing and the radiation screen, with pump surfaces for condensable gases, disposed on the cold head, with a collecting chamber for liquid condensate developing during regeneration of the pump and with an outlet pipe, which is used for removal of the gases which have settled on the pump surfaces during regeneration and the inlet opening of which is in the region of the collecting chamber.

2. Description of the Related Art

It had already been proposed in connection with a cryogenic pump of this type to achieve the regeneration of the pump surfaces —preferably the pump surfaces of the second stage of a two-stage cryogenic pump—in that the temperature of the pump surface to be regenerated and the pressure in the pump are raised to values above the triple point of the gases to be removed and that the condensates being removed from the pump surface are removed—in liquid and/or gas form—via the outlet pipe. The preferably liquid condensate being generated during the regeneration of the pump collects in the bottom region of the vertically attached pump and flows off to the outside through the outlet pipe, the inlet opening of which is located in the bottom region of the radiation screen. "Vertical attachment" is intended to mean that the axis of the pump which is essentially designed cup-shaped is essentially vertically disposed.

There is an increasing necessity to attach cryogenic pumps of the type described horizontally, i.e. they must be connected with a recipient in such a way that the axis of the pump housing extends horizontally. If the above described regeneration process is performed on a pump disposed in this manner, the liquid condensate no longer collects in the region of the inlet opening of the outlet pipe. A rapid removal of the condensate via the outlet pipe is therefore no longer possible, so that it becomes necessary to forego the advantage of the particularly short regeneration time of the described regenerating process. Because no clearly defined "lowest point" is present, only slowly evaporating condensate pools are formed. If this occurs in the region of the inlet flange, there is the danger of damage to the O-rings usually employed because of the cold acting on them, which results in leaks.

It is the object of the present invention to design a cryogenic pump with the characteristics of the preamble of claim 1 in such a way that the described disadvantages are no longer present.

SUMMARY OF THE INVENTION

In accordance with the invention this object is attained in that the condensate collection chamber is laterally disposed in such a way that the pump can be regenerated even if horizontally attached and without having to accept the disadvantages of long regenerating times and/or the danger of damage to the seals. Because there always is a defined "lowest point", to which the outlet pipe is connected, the pump in accordance with the invention has the same advantages, also in respect to its regeneration properties, as the already proposed pump with vertical attachment.

BRIEF DESCRIPTION OF THE DRAWINGS

Further advantages and details of the invention are to be explained by means of exemplary embodiments illustrated in FIGS. 1 to 5.

FIGS. 1 and 2 show, respectively, an elevational side view and a cross-sectional side view of one embodiment according to the invention;

FIG. 3 shows a cross-sectional side view of another embodiment according to the invention.

DESCRIPTION OF THE PREFERRED EMBODIMENTS

Figure 4:
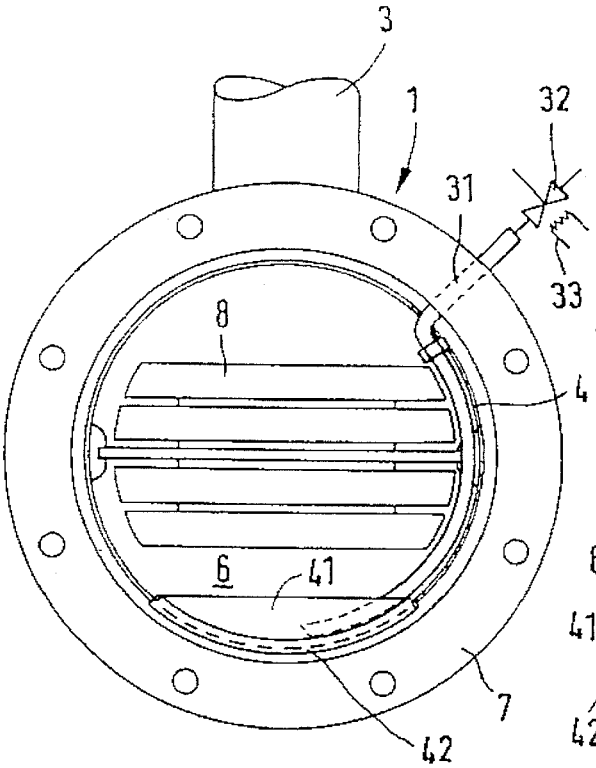
FIGS. 4 and 5 show, respectively, an elevational side view and a cross-sectional side view of yet another embodiment according to the invention.

In all drawing figures, the cryogenic pump is identified by 1, its exterior housing by 2, the cold head by 3 and the radiation screen by 4. The housing 2 and the radiation screen 4 have an essentially pot-shaped form and are arranged concentrically in respect to each other. Their axis is indicated by 5. The open sides of the housing 2 and the radiation screen 4 form the inlet opening 6 of the pump 1. The housing flange 7 is used to fasten the pump to a recipient—preferably via a valve, not shown —. In addition, the baffle 8, supported by the radiation screen 4, is located in the inlet region of the pump 1.

The cold head 3, extending laterally into the pump housing 2 and the radiation screen 4, is embodied to be in two-stages (stages 11, 12). The cold is generated, for example, with the aid of a refrigerator, not shown in detail, operating in accordance with the Gifford-McMahon principle. The first stage 11 of the cold head 3 is connected, thermally well conducting, with the radiation screen 4, so that the radiation screen 4 and also the baffle 8 take on the temperature of this stage 11. The second stage 12 of the cold head is located in the pump interior 13. By means of a thermally well conducting copper block 14 it supports the pump surfaces, generally indicated by 15, of the second stage. These include exterior pump surfaces 16, on which the condensable gases argon, nitrogen, oxygen, etc. settle. Inner surface areas 17, covered with adsorption material, are additionally provided, which are used for the adsorption of lighter gases (hydrogen, helium, etc.).

In the exemplary embodiments in accordance with FIGS. 1 and 2, either the pump flange 7 itself or—as illustrated in FIG. 2—an adapter flange 21 are equipped with a recess 22 cut into the inside of the respective flange. The recess 22 is disposed in such a way that it is basically always on the bottom, so that liquid condensate collects therein. If the recess 22 is in the adapter flange 21, the functionally correct position of the recess 22 can be assured by the appropriate installation of this adapter flange. The radiation screen 4 has at least in its lower region a pouring spout 23 which is shaped in such a way that condensate flowing out of the screen flows into the recess 22. In a practical way the radiation screen 4 has an outwardly widening rim section 24 for this purpose.

To prevent the cold condensate from coming into direct contact with the flanges 7 or 21 and in this way endangering the flange seal rings 25, 26 because of the effects of the cold, a catch basin 27 inserted into the recess 22 at a distance is provided. The undesired cooling of the flanges 7 or 21 is prevented by means of this. The catch basin 27 itself should have as low a mass as possible, so that it rapidly takes on the temperature of the liquid condensate. Unnecessary evaporation of the condensate is avoided or a rapid flow-off of the condensate is assured by means of this.

The outlet pipe used for removing the condensate is identified by 31. It terminates directly in the recess 22 or—if the illustrated catch basin 27 is present—in this catch basin. It is led out radially through the respective flange 7 or 21. The valve 32 is located outside of the pump and is opened for discharging the condensate. This valve 32 is equipped with a heating device 33 which protects the valve seal from harmful effects because of the cold of the condensate.

In the exemplary embodiment in accordance with FIG. 3, the radiation screen 4 is provided with a widening of the diameter at the bottom, so that the condensate collects laterally in the bottom region of the radiation screen 4, even with the pump 1 attached horizontally. The outlet pipe 31, which is also led outward through a bore 34 in the flange 7, has been extended into the interior pump chamber 13 in such a way that its inlet opening is located in the collecting chamber formed by the widening of the diameter. A pump 1 embodied in this manner has the advantage that it can be attached horizontally as well as vertically—and in all intermediate positions—if it has been provided that the collecting chamber with the inlet opening of the outlet pipe 31 respectively forms the lowest point. In a practical manner it is also possible that the bottom of the radiation screen 4 is arched inward (see the bottom line 35 represented in dashed lines).

Figure 5:
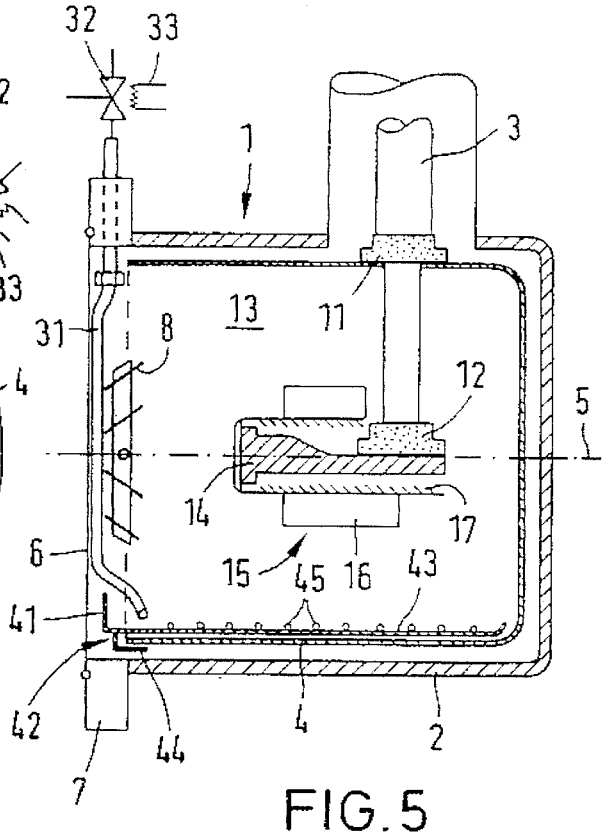

With the exemplary embodiments of FIGS. 4 and 5, an essentially sickle-shaped cover plate 41 is provided which, together with the part of the radiation screen located on the bottom, forms the collecting chamber. The phrase "an essentially sickle-shaped cover plate 41" as used herein is a slender, flat cover having at least one circular arcuate peripheral portion. In a practical manner the cover plate 41 is removably fastened on the rim of the radiation screen 4, so that it can be brought in a simple manner into the respectively correct—lower—position. For example, it can be equipped with a support 42 having two sections 43 and 44 embracing the rim of the radiation screen 4, so that secure holding is assured. The outlet pipe 31 can be led out of the pump 1 at any arbitrary place, for example—as shown—again through the radial bore in the flange 7. It is essential that its inlet opening is located in the region of the cover plate 41.

To achieve the rapid thawing of still solid condensate, which falls into the collecting chamber because of the force of gravity, it is practical to provide a heating device in the collecting chamber. In the exemplary embodiment in accordance with FIG. 5, this heating device (heat conductor 45) is disposed on the inner section 43 of the support 42 for the cover plate 41. In this way it forms a unit with the cover plate 41, so that with correct assembly the sickle and the heating device are always in the collecting chamber.

What is claimed is:

1. A cryogenic pump intended to be horizontally attached and comprising:

an essentially cup-shaped housing, an essentially cup-shaped radiation screen concentrically disposed in the housing and having an inlet opening provided with a baffle supported by the radiation screen, a two-stage cold head extending into the housing and the radiation screen, the first stage of said cold head being connected with the radiation screen in a thermally well conducting manner and the second stage of which cold head being connected in a thermally well conducting manner with pump surfaces for the condensation of argon, nitrogen, oxygen, etc., as well as with pump surfaces for the adsorption of lighter gases (hydrogen, helium, etc.), a collecting chamber for condensate developing during regeneration of the pump is provided underneath the pump surfaces of the second stage of the cold head, wherein the collecting chamber is constituted by an element selected from the group consisting of:

(a) the cup-shaped radiation screen in that its diameter increases in the direction toward the bottom in such a way that the collecting chamber for liquid condensate is located in the bottom region of the cup-shaped radiation screen, and the inlet opening of an outlet pipe, which is used for the removal of the gasses deposited on the pump surfaces during the regeneration of the pump surfaces, being located in the region of the collecting chamber, (b) the cup-shaped radiation screen so that the cup-shaped radiation screen is a part of the collecting chamber, the rim of the radiation chamber forming a collecting chamber and being provided with an essentially sickle-shaped cover plate, and the inlet opening of an outlet pipe, which is used for the removal of the gasses deposited on the pump surfaces during the regeneration of the pump surfaces, being located in the region of the collecting chamber, and (c) formed by providing the pump with an inlet flange and a recess in the inside of the flange, which recess forms the collecting chamber.

2. A pump in accordance with claim 1, wherein the collecting chamber is constituted by (a) the cup-shaped radiation screen, and wherein the bottom of the radiation screen is arched inward.

3. A pump in accordance with claim 1, wherein the collecting chamber is constituted by (a) the cup-shaped radiation screen, and wherein the outlet pipe extending inside the radiation screen is led to the exterior through a radial bore in the inlet flange.

4. A pump in accordance with claim 1, wherein the collecting chamber is constituted by (a) the cup-shaped radiation screen, and wherein the pump further comprises a heating device located in the region of the collecting chamber.

5. A pump in accordance with claim 4, wherein the heating device is disposed on the inner section of the support of the cover plate.

6. A pump in accordance with claim 1, wherein the collecting chamber is (c) formed by providing the pump with an inlet flange and a recess in the inside of the flange, which recess forms the collecting chamber, and wherein the recess is basin-shaped, the outlet pipe terminating in the bottom of the tub and the outlet pipe being radially lead through the flange to the outside.

7. A pump in accordance with claim 1, wherein the collecting chamber is (c) formed by providing the pump with an inlet flange and a recess in the inside of the flange, which recess forms the collecting chamber, and wherein the rim of the cup-shaped radiation screen extends as far as the region of the recess, and is provided with a pouring spout in such that the condensate flowing from the radiation screen reaches the recess.

8. A pump in accordance with claim 1, wherein the collecting chamber is (c) formed by providing the pump with an inlet flange and a recess in the inside of the flange, which recess forms the collecting chamber, and wherein the flange equipped with the recess is an adapter flange.

9. A pump in accordance with claim 1, wherein the collecting chamber is (c) formed by providing the pump with an inlet flange and a recess in the inside of the flange, which recess forms the collecting chamber, and wherein the radiation screen has a rim section widening toward the exterior.

10. A pump in accordance with claim 1, wherein the collecting chamber is (c) formed by providing the pump with an inlet flange and a recess in the inside of the flange, which recess forms the collecting chamber, and wherein a catch basin of low mass is inserted into the recess, maintaining a short distance from the recess and the outlet pipe terminating in the bottom of the catch basin.

11. A cryogenic pump intended to be horizontally attached and comprising:

an essentially cup-shaped housing, an essentially cup-shaped radiation screen concentrically disposed in the housing and having an inlet opening provided with a baffle supported by the radiation screen, a two-stage cold head extending into the housing and the radiation screen, the first stage of said cold head being connected with the radiation screen in a thermally well conducting manner and the second stage of said cold head being connected in a thermally well conducting manner with pump surfaces for the condensation of argon, nitrogen, oxygen, etc., as well as with pump surfaces for the adsorption of lighter gases (hydrogen, helium, etc.), a collecting chamber for condensate developing during regeneration of the pump is provided underneath the pump surfaces of the second stage of the cold head, wherein the cup-shaped radiation screen is a part of the collecting chamber, the rim of the radiation chamber forming a collecting chamber and being provided with an essentially sickle-shaped cover plate, and the inlet opening of an outlet pipe, which is used for the removal of the gasses deposited on the pump surfaces during the regeneration of the pump surfaces, being located in the region of the collecting chamber.

12. A pump in accordance with claim 11, wherein the cover plate is removably fastened to the radiation screen.

13. A pump in accordance with claim 12, wherein a support, adapted to the shape of the rim of the radiation screen and having sections embracing the rim, is provided for the cover plate.

14. A cryogenic pump intended to be horizontally attached and comprising:

an essentially cup-shaped housing, an essentially cup-shaped radiation screen concentrically disposed in the housing and having an inlet opening provided with a baffle supported by the radiation screen, a two-stage cold head extending into the housing and the radiation screen, the first stage of said cold head being connected with the radiation screen in a thermally well conducting manner and the second stage said cold head being connected in a thermally well conducting manner with pump surfaces for the condensation of argon, nitrogen, oxygen, etc., as well as with pump surfaces for the adsorption of lighter gases (hydrogen, helium, etc.), a collecting chamber for condensate developing during regeneration of the pump provided underneath the pump surfaces of the second stage of the cold head, wherein the pump is equipped with an inlet flange and a recess in the inside of the flange forming the collecting chamber.

15. A pump in accordance with claim 14, wherein the recess is basin-shaped, the outlet pipe terminating in the bottom of the tub and the outlet pipe being radially lead through the flange to the outside.

16. A pump in accordance with claim 14, wherein the rim of the cup-shaped radiation screen extends as far as the region of the recess, and is provided with a pouring spout in such that the condensate flowing from the radiation screen reaches the recess.

17. A pump in accordance with claim 14, wherein the flange equipped with the recess is an adapter flange.

18. A pump in accordance with claim 14, wherein the radiation screen has a rim section widening toward the exterior.

19. A pump in accordance with claim 14, wherein a catch basin of low mass is inserted into the recess, maintaining a short distance from the recess and the outlet pipe terminating in the bottom of the catch basin.

* * * * *